United States Patent [19]

Stapenséa

[11] Patent Number: 4,898,146

[45] Date of Patent: Feb. 6, 1990

[54] HEATING APPLIANCE

[75] Inventor: Jan A. Štapenséa, Gasteren, Netherlands

[73] Assignee: Fasto B.V., Buinen, Netherlands

[21] Appl. No.: 280,383

[22] Filed: Dec. 6, 1988

[30] Foreign Application Priority Data

Dec. 10, 1987 [NL] Netherlands ..... 8702987

[51] Int. Cl.[4] ..... F24H 3/00

[52] U.S. Cl. ..... 126/116 A; 165/40; 237/8 C

[58] Field of Search ..... 126/374, 389, 351, 110 C, 126/116 A, 19 R; 165/40; 237/2 A, 8 C; 236/1 A, 15 BB, 15 BD

[56] References Cited

U.S. PATENT DOCUMENTS

| | | | |
|---|---|---|---|
| 3,861,856 | 1/1975 | Smalling | 236/15 BD X |
| 4,364,724 | 12/1982 | Alpkuist | 236/15 BD X |
| 4,421,473 | 12/1983 | Londerville | 236/15 BD X |
| 4,465,456 | 8/1984 | Hynek et al. | 236/15 BD X |
| 4,667,876 | 3/1987 | Negishi | 237/2 AX |
| 4,676,734 | 6/1987 | Foley | 236/15 BD |

FOREIGN PATENT DOCUMENTS

| | | |
|---|---|---|
| 232230 | 8/1987 | European Pat. Off. . |
| 1199423 | 8/1965 | Fed. Rep. of Germany . |
| 3604842 | 8/1987 | Fed. Rep. of Germany . |
| 2464437 | 3/1981 | France . |
| 7904813 | 6/1979 | Netherlands . |

*Primary Examiner*—Larry Jones

*Attorney, Agent, or Firm*—Edmund M. Jaskiewicz

[57] ABSTRACT

A heating appliance has a burner of the type having full premixing and forced draught and a mixing chamber to which an air supply line and a fuel supply are connected. The mixing chamber has a burner plate which is provided with apertures and which adjoins a combustion chamber in which a heat exchanger is disposed some distance from the burner plate and is passed through by the medium to be heated. A flue is connected to the combustion chamber. The effective heat transfer of the flue gases to the heat exchanger is varied depending on the load on the heating appliance.

12 Claims, 3 Drawing Sheets

HEATING APPLIANCE

BACKGROUND OF THE INVENTION

The present invention relates to a heating appliance, comprising a burner of the type having full premixing and forced draught, and having a mixing chamber to which an air supply line and a fuel supply are connected, said mixing chamber having a burner plate which is provided with apertures and which adjoins a combustion chamber in which a heat exchanger is disposed some distance from the burner plate and is passed through by a medium to be heated, a flue being connected to said combustion chamber.

Such a heating appliance is known, for example, from Dutch Patent Application 7906458. Such burners work with a certain gas/air mix ratio to obtain good combustion with the highest possible output. In order to adapt the heat production to the heat demand, the quantity of gas is varied, so that the quantity of air supplied also has to be varied to obtain the desired mix ratio. The problem occurring with such a modulating control is that at a minimum load on the heating appliance, i.e. when little fuel and consequently little combustion air are supplied, the heat transfer surface of the heat exchanger is relatively large compared with the quantity of flue gases flowing past it through the heating appliance. The result of this is that at minimum load the flue gases are greatly cooled, even to below dew point, so that condensation will occur. If the design is not suitable for condensation, or if the condensation cannot be discharged because the appliance is fitted at a place which is unsuitable for this the occurrence of condensation is an undesirable phenomenon which must be avoided.

SUMMARY OF THE INVENTION

The object of the present invention is to produce a heating appliance of the type mentioned in the preamble, in which the above problem is avoided in a simple and effective manner.

This object is achieved according to the invention in that means are present for varying the effective heat transfer of the flue gases to the heat exchanger depending on the load on the heating appliance.

In this way the heat transfer of the flue gases to the heat exchanger can be reduced when the heating appliance is functioning at a minimum load. As a result the flue gases will not be cooled to below their dew point and no condensation will occur.

In a first embodiment of the invention the means for varying the effective heat transfer of the flue gases to the heat exchanger comprise an additional air supply line which opens into the combustion chamber in the space between the heat exchanger and the burner plate, and means are present to ensure that the quantity of air conveyed via this supply line directly into the combustion chamber is regulated depending on the load on the heating appliance.

Conveying an additional quantity of air directly into the combustion chamber when there is a low load on the heating appliance means that the flue gases are mixed with colder ambient air before they come into contact with the heat exchanger. The heat exchanger thus comes into contact with a larger volume flow of flue gases, with the result that less heat is given off per volume unit of flue gases. The ambient air must be mixed with the flue gases here in such a way that the temperature of said flue gases does not fall below dew point. The greater volume flow through the combustion chamber or the shorter residence time of the flue gases in the combustion chamber will, however, make the flue loss increase. Every effort is being made to ensure that at a low load on the heating appliance this flue loss is thus approximately the same as the flue loss at maximum load on the heating appliance when no additional ambient air is supplied to the combustion chamber.

According to a preferred embodiment of the invention, the additional air supply line to the combustion chamber is a branch line from the air supply line leading to the burner.

According to the invention, the combustion chamber is provided along the outer periphery with a duct to which the air supply line is connected, and which is in communication with the combustion chamber via a number of inlet ports disposed in the wall of the combustion chamber. In this way the additional ambient air is fed into the combustion chamber so that it is distributed uniformly, in such a way that a homogeneous mixture flowing past the heat exchanger is produced.

The means for regulating the quantity of air fed into the combustion chamber preferably comprise a control valve which is accommodated in the additional air supply line and which is controlled by means of the temperature of the discharged flue gases.

According to another embodiment of the invention, the means for varying the effective heat transfer of the flue gases to the heat exchanger comprise a partition, which is provided in the combustion chamber and which extends essentially in the direction of flow of the flue gases, and which divides the part of the combustion chamber containing the heat exchanger into two compartments, one compartment having an open connection to the flue, and the other compartment can be shut off from the flue by means of a valve which is controlled depending on the load on the heating appliance.

DESCRIPTION OF THE DRAWINGS

The invention will be explained in more detail with reference to the attached drawing, in which.

DESCRIPTION OF THE PREFERRED EMBODIMENTS

Figure 1:
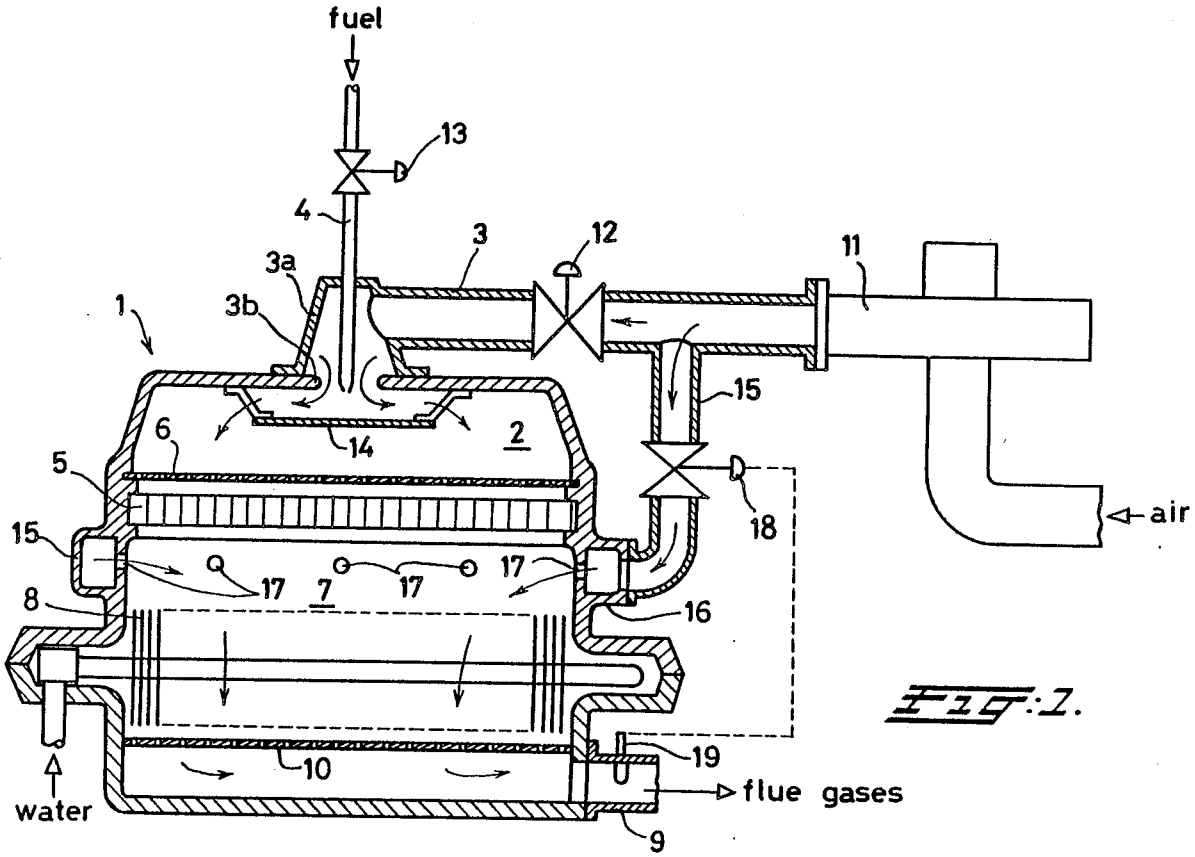
FIG. 1 shows a first embodiment of the invention.
Figure 2:
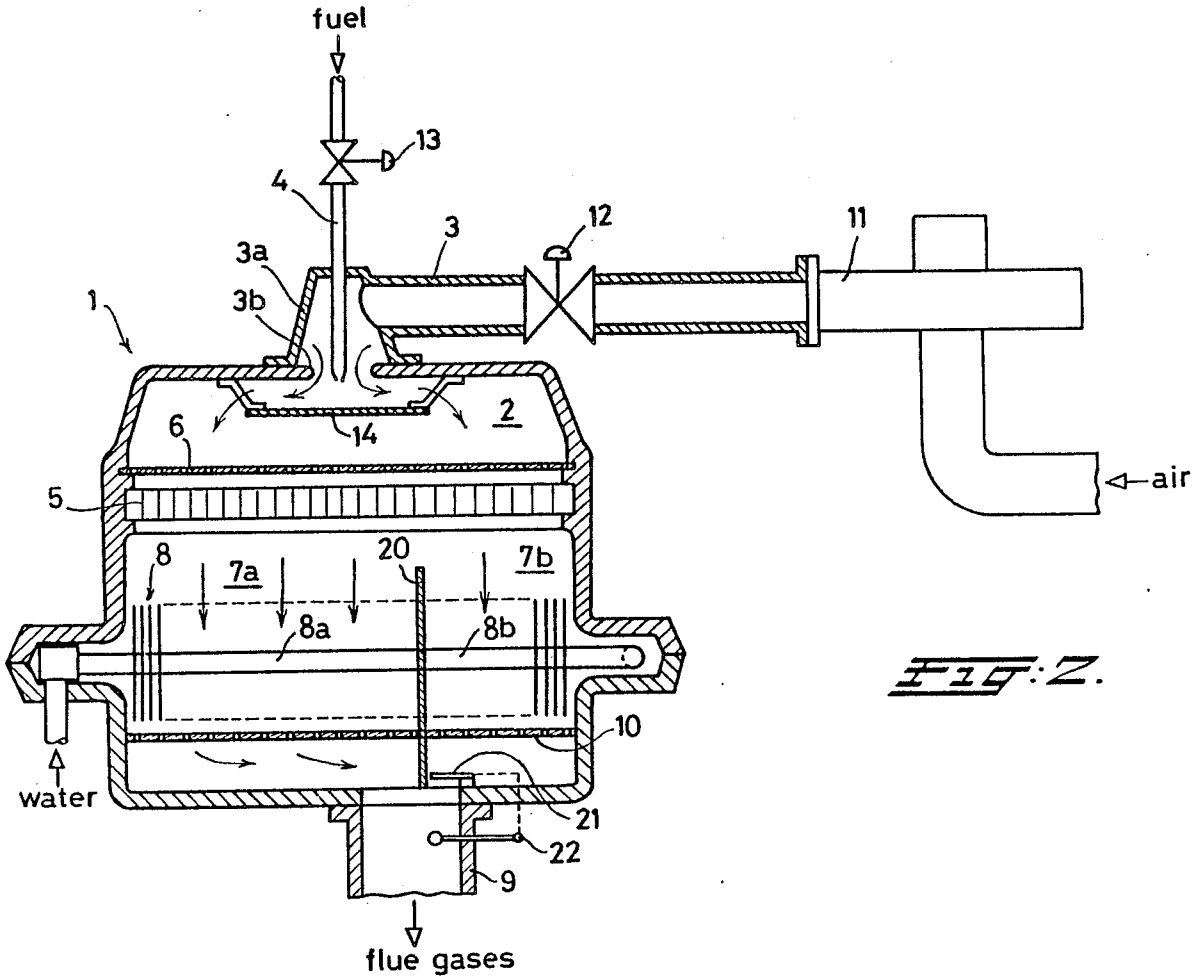
FIG. 2 shows a second, alternative embodiment of the invention.
Figure 3:
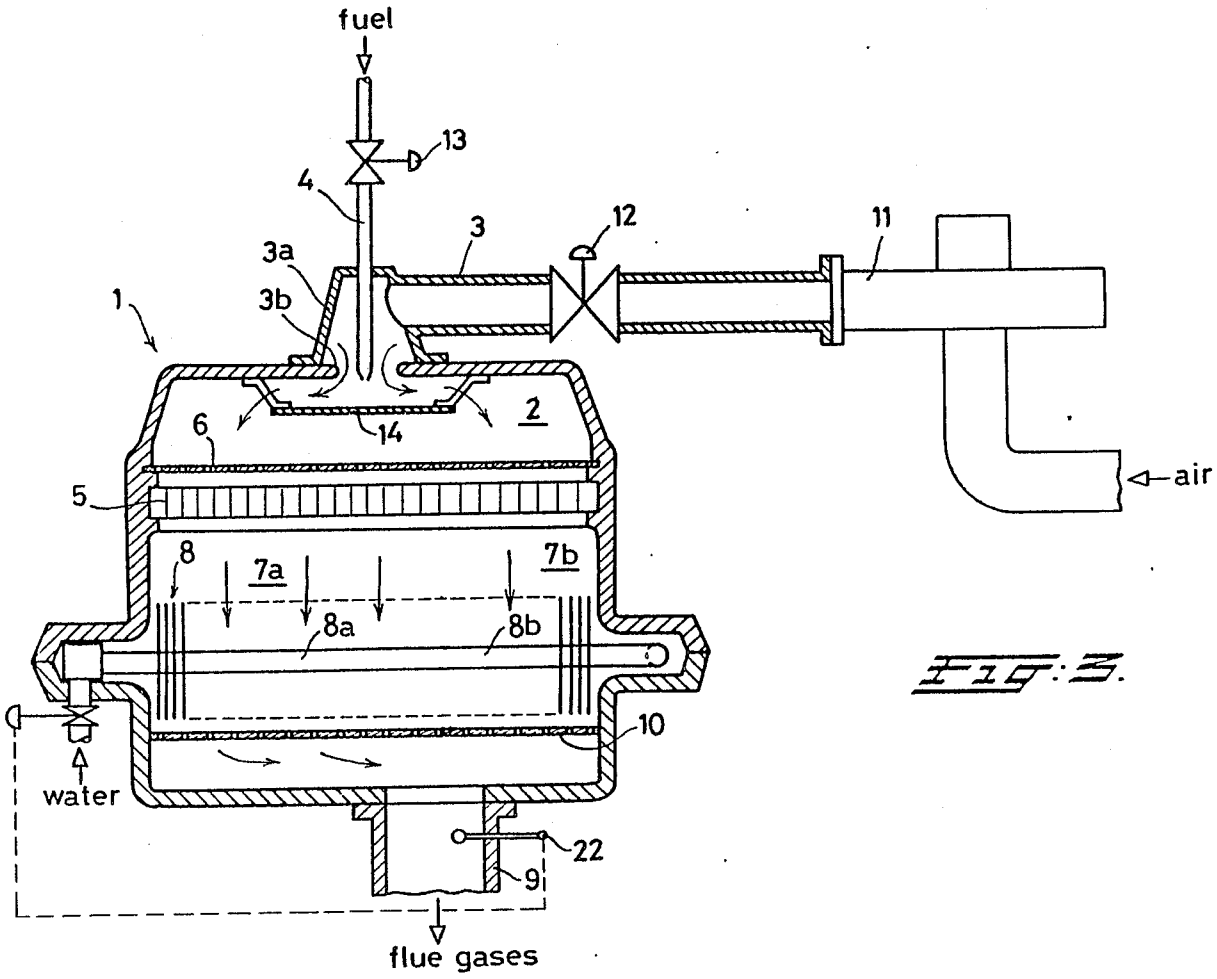
FIG. 3 shows a third, alternative embodiment of the invention.

FIGS. 1 and 2 show a heating appliance for heating a medium, indicated in its entirety by reference number 1, comprising a burner consisting of a mixing chamber 2 to which an air supply line 3 and a fuel supply 4 are connected at one side, and which is bounded at the other side by a burner plate 5 provided with apertures. A perforated plate 6 for distributing the gas/air mixture uniformly and damping any turbulence is disposed inside the mixing chamber some distance away from the burner plate 5.

The burner plate at the other side bounds a combustion chamber 7, containing a heat exchanger 8 in the form of a finned pipe through which the medium to be heated flows. The combustion chamber 7 is also provided with a flue 9, and another perforated plate 10 is disposed between the flue 9 and the heat exchanger 8 for the purpose of obtaining a uniform flow of the flue gases past the heat exchanger 8.

For the purpose of obtaining a forced draught through the heating appliance, the air inlet line 3 is connected to a fan 11, while a control valve 12 is fitted in the air inlet line to regulate the quantity of air supplied to the burner. The fuel supply line is also provided with a gas control valve 13. The control valves 12 and 13 are controlled independently of one another, so that the desired gas/air mix ratio is always fed to the burner. This modulating control can be carried out in various ways, which are known per se and need not be discussed further here.

The air supply line 3 opens out through an inlet nozzle 3*a* with an orifice plate 3*b* into the mixing chamber 2, the gas line 4 also opening out near said orifice plate. A dividing plate 14 is fitted inside the mixing chamber some distance away from the orifice plate.

In the embodiment shown in FIG. 1 a branch line 15 branches off from the line 3 and is connected to a duct 16 which runs all the way round the combustion chamber and is connected by means of a number of inlet ports 17 to the space of the combustion chamber situated between the burner plate 5 and the heat exchanger.

The line 15 is provided with a control valve 18 which regulates the quantity of air supplied to the combustion chamber depending on the lad on the heating appliance.

The valve 18 can be controlled in various ways, for example as shown in the drawing, by means of a temperature sensor 19 in the outgoing flue gases. Instead of by means of the temperature of the flue gases, the control of the valve 18 can also be carried out by means of volume measurement or pressure measurement of the flue gases.

The control of the valve 18 can also be carried out, if desired, by a temperature sensor in the medium of the heat exchanger, or depending on the quantity of gas.

The quantity of additional outside air supplied to the combustion chamber can be set through the setting of the valve 18 (and/or of the valve 12).

The total control of the appliance could be carried out, for example, as follows, assuming that the fan 11 continues to rotate at a constant speed:

- at maximum load on the appliance the valve 18 is closed, and the valve 12 is open, while the gas valve 13 is fully open;
- when there is a decrease in the load (demand for heat) the valve 12 is closed slightly;
- the quantity of air flowing through the orifice plate 3*b* decreases, so that a lower pressure drop will occur over this aperture;
- the gas valve 13 is controlled on the basis of the change in this pressure difference, and when this pressure difference decreases the gas valve 13 is closed slightly. In total, a small volume of gas/air mixture will thus be conveyed to the burner;
- due to the decrease in the quantity of flue gases, the temperature thereof will fall in the flue 9, which is recorded by the sensor 19;
- the sensor 19 makes the valve 18 open slightly, so that additional air is conveyed through the apertures 17 into the combustion chamber. The flue gas volume will consequently increase, resulting in a rise in the temperature of the flue gas. Every effort will be made to ensure a flue gas temperature which is as high as that at the maximum load on the heating appliance, so that the output is virtually the same in both load conditions.

FIG. 2 shows another embodiment of the invention, in which the same parts are indicated by the same reference numbers. Instead of an additional air supply to the combustion chamber 7, the combustion chamber contains a partition 20 extending essentially in the direction of flow of the flue gases. The partition extends from the flue 9 to some distance from the burner plate 5 and divides the combustion chamber 7 into two compartments 7*a* and 7*b*. The compartment 7*a* has an open connection to the flue 9, while the compartment 7*b* can be shut off relative to the flue by means of a valve 21. The valve 21 can be controlled, for example, by means of a temperature sensor 22 which measures the temperature of the flue gases. As an alternative, the valve can, for example, be controlled on the basis of the air quantity coming into the mixing chamber through the orifice plate 3*b*, or the quantity of gas supplied.

The partition 20 also divides the heat exchanger 9 into two parts 8*a* and 8*b*. It is clear that the part 8*b* of the heat exchanger works little if at all when the valve 21 is closed, which is the case when the heating appliance is operating at a low load. Since in this load state the effective heat transfer of the flue gases to the heating medium is reduced, the flue gases will not be cooled below their dew point.

The heat transfer of the flue gases to the heat exchanger could as a possible (not shown) alternative be reduced by a decrease in the quantity of a medium to be heated flowing through the heat exchanger. This could, for example, be achieved by fitting in the heating medium line a regulable resistance element which is controlled by means of the temperature of the flue gases. This means that at a low load on the heating medium less heating medium will flow through the heat exchanger, and the flue gases will thus be cooled down less.

It will be clear that the invention is not limited to the embodiments shown and described, but that many variations are possible within the scope of the appended claims, both as regards the design and as regards the control.

What is claimed is:

1. A heating appliance, comprising a burner of the type having a full premixing and forced draught, and having a mixing chamber to which an air supply line and a fuel supply are connected, said mixing chamber having a burner plate which is provided with apertures and which adjoins a combustion chamber in which a heat exchanger is disposed some distance from the burner plate and is passed through by a medium to be heated, a flue being connected to said combustion chamber, and means in the heating appliance for varying the effective heat transfer of the flue gases to the heat exchanger to prevent cooling of the flue gases below their dew point under low load conditions of the heating appliance.

2. A heating appliance according to claim 1, characterized in that the means for varying the effective heat transfer of the flue gases to the heat exchanger comprise an additional air supply line which opens into the combustion chamber in the space between the heat exchanger and the burner plate, and means are present to ensure that the quantity of air conveyed via this supply line directly into the combustion chamber is regulated depending on the load on the heating appliance.

3. A heating appliance according to claim 2, characterized in that the air supply line to the combustion chamber is a branch line from the air supply line leading to the burner.

4. A heating appliance according to claim 3, characterized in that the combustion chamber is provided along the outer periphery with a duct to which the air supply line is connected, and which is in communication with the combustion chamber via a number of inlet ports disposed in the wall of the combustion chamber.

5. A heating appliance according to claim 4, characterized in that the air supply line to the combustion chamber is provided with a control valve which is controlled depending on the temperature of the discharged flue gases.

6. A heating appliance according to claim 1, characterized in that the means for varying the effective heat transfer of the flue gases to the heat exchanger comprise a partition which is provided in the combustion chamber and which extends essentially in the direction of flow of the flue gases, and which divides the part of the combustion chamber containing the heat exchanger into two compartments, one compartment having an open connection to the flue, and the other compartment can be shut off from the flue by means of a valve which is controlled depending on the load on the heating appliance.

7. A heating appliance according to claim 6, characterized in that the valve is controlled by means of the temperature of the discharged flue gases.

8. A heating appliance according to claim 1, characterized in that the means for varying the effective heat transfer of the flue gases to the heat exchanger consist of a regulable resistance element which is fitted in the line for the heating medium, and which regulates the volume flow of the medium to be heated flowing through the heat exchanger depending on the load on the heating appliance.

9. A heating appliance according to claim 8, characterized in that the resistance element is regulated with reference to the temperature of the discharged flue gases.

10. A heating appliance according to claim 1 wherein said means for varying the effective heat transfer comprises means for mixing ambient air with the flue gases before they pass through the heat exchanger.

11. A heating appliance according to claim 1 wherein said means for varying the effective heat transfer comprises means for reducing the heat exchange surfaces of the heat exchanger through which the flue gases pass.

12. A heating appliance according to claim 1 wherein said means for varying the effective heat transfer comprises means for decreasing the quantity of medium flowing through the heat exchanger.

* * * * *